US008225999B2

(12) United States Patent
Heuer

(10) Patent No.: US 8,225,999 B2
(45) Date of Patent: Jul. 24, 2012

(54) METHOD AND DEVICE FOR CONTROLLING THE CADENCE OF AN AUTOMATIC WEAPON

(75) Inventor: Jürgen Heuer, Soltau (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 299 days.

(21) Appl. No.: 12/732,650

(22) Filed: Mar. 26, 2010

(65) Prior Publication Data

US 2010/0237147 A1 Sep. 23, 2010

Related U.S. Application Data

(63) Continuation-in-part of application No. PCT/EP2008/007180, filed on Sep. 3, 2008.

(30) Foreign Application Priority Data

Sep. 27, 2007 (DE) ..... 10 2007 046 545

(51) Int. Cl.
*G06F 19/00* (2006.01)

(52) U.S. Cl. ..... 235/400; 42/70.01

(58) Field of Classification Search ..... 235/400, 235/405, 407; 42/70.01, 84
See application file for complete search history.

(56) References Cited

U.S. PATENT DOCUMENTS

| | | | | |
|---|---|---|---|---|
| 2,212,687 | A | 8/1940 | Hughes | |
| 2,363,966 | A | 11/1944 | Ironside | |
| 3,496,829 | A | 2/1970 | Heuser et al. | |
| 4,796,512 | A | 1/1989 | Koine | |
| 7,621,210 | B2 | 11/2009 | Fluhr et al. | |
| 2004/0020094 | A1 | 2/2004 | Ealovega | |
| 2005/0141997 | A1 | 6/2005 | Rast | |
| 2005/0257676 | A1 | 11/2005 | Ealovega | |
| 2009/0255160 | A1 * | 10/2009 | Summers | 42/70.01 |

FOREIGN PATENT DOCUMENTS

| | | |
|---|---|---|
| DE | 15 78 411 | 9/1970 |
| DE | 60 2004 002 901 T2 | 4/2007 |
| EP | 1 816 428 A | 8/2007 |

OTHER PUBLICATIONS

Office Action issued in corresponding German application 10 2007 046 545.0 on Aug. 8, 2011 (no translation available; submitted for certification).

International Search Report issued in corresponding application PCT/EP2008/007180, completed Feb. 6, 2009, mailed Feb. 16, 2009.

Davor Curl, "PSA Tactical Training", downloaded from www.tactical-spec.com on Mar. 11, 2010.

* cited by examiner

*Primary Examiner* — Karl D. Frech
(74) *Attorney, Agent, or Firm* — Griffin & Szipl, P.C.

(57) ABSTRACT

The aim of the invention is to devise an inexpensive method and device that allows predefined target tolerances of an automatic weapon (1) to be maintained even in the range of prevailing resonant cadences. This aim is achieved by modifying the actual cadence of the automatic weapon from shot to shot around a predefined cadence lying within the range of a resonant cadence so that the time interval between successively triggered shots is alternately shorter and longer than the calculated constant time interval between the individual triggered shots that is calculated for the predefined cadence and that corresponds to the constant time interval required to fire the automatic weapon at the predefined cadence. In this way, the automatic weapon is controlled to fire at a time averaged cadence that is equal to the desired predefined cadence while avoiding ever actually firing the automatic weapon, shot-by-shot, at the resonant cadence.

8 Claims, 1 Drawing Sheet

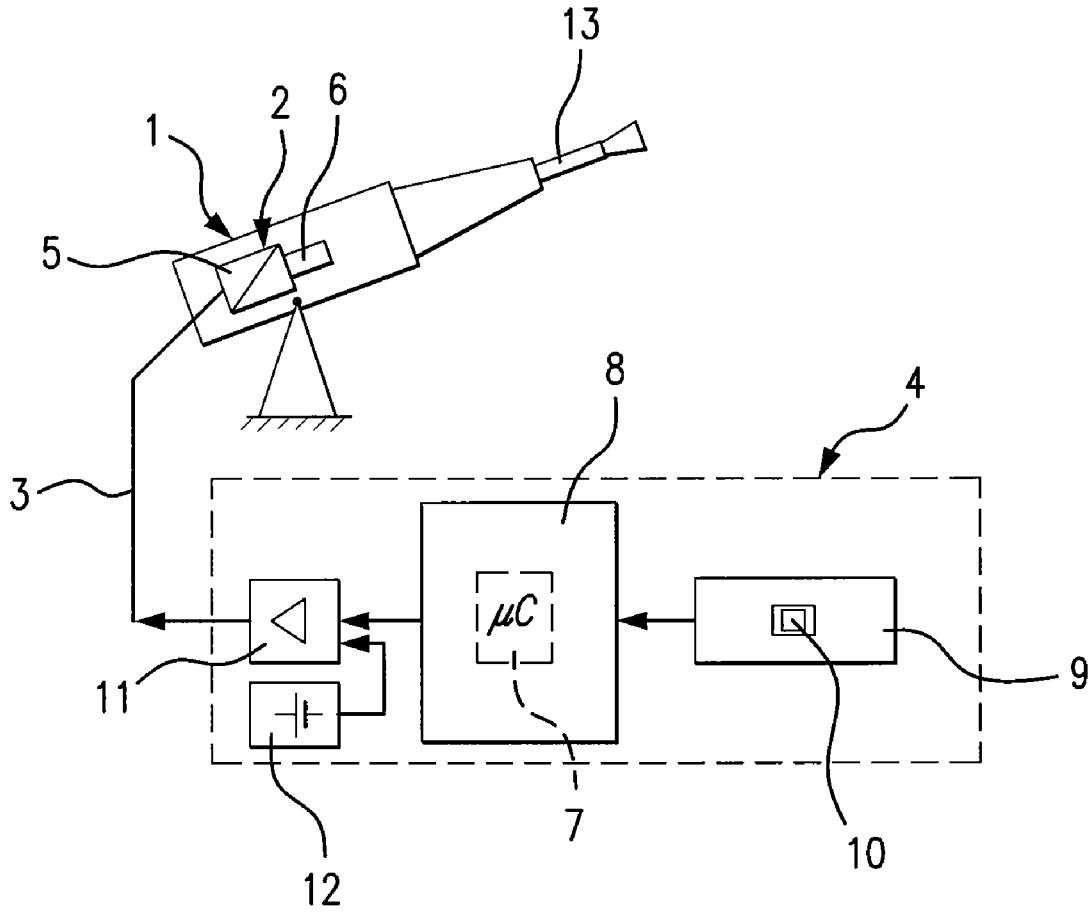
13
2
6
1
5
8
4
3
μC
11
9
7
10
12

METHOD AND DEVICE FOR CONTROLLING THE CADENCE OF AN AUTOMATIC WEAPON

This is a Continuation-in-Part Application in the United States of International Patent Application No. PCT/EP2008/007180 filed Sep. 3, 2008, which claims priority on German Patent Application No. 10 2007 046 545.0, filed Sep. 27, 2007. The entire disclosures of the above patent applications are hereby incorporated by reference.

FIELD OF THE INVENTION

The invention relates to a method for controlling the cadence of an automatic weapon. The invention further relates to a device for carrying out this method.

BACKGROUND OF THE INVENTION

With automatic weapons, in which the discharge takes place with the aid of electrical triggering, it is known to modify the cadence (i.e., cadence fire, individual shots, etc.) according to predefined conditions by means of an appropriate device. In other words, the "cadence" of an automatic weapon is defined as its fire speed or rate of fire.

With known weapon systems, it has been found to be a problem that barrel oscillations can occur at certain cadences (also referred to below as "resonant cadences") that lie below the natural cadence of the weapon predefined by the inertia of the action of the automatic weapon. When such resonant cadences occur, relatively high divergences can result in the dispersion pattern, wherein although the respective first shot hits the target on the line of sight, all the following shots frequently lie outside the range of tolerance.

Therefore, if the customer for such a weapon requires a cadence (i.e., firing speed) at which barrel oscillations occur, a shift of the resonance frequency of the weapon barrel and, thus, of the resonant cadence of the weapon has hitherto been undertaken by stiffening the barrel mount or the barrel (for example, by fixing the barrel muzzle). However, these measures are associated with high construction costs and, as a rule, lead to an increase in the weight of the weapon and in the space needed for the weapon. Moreover, after such construction modifications have been carried out, a fresh testing of the weapon and, as a rule, also a new approval of the weapon by a responsible authority is required.

The object of the invention is to provide a cost-effective method with which it is possible to maintain predefined target tolerances of an automatic weapon even in the range of prevailing resonant cadences. Moreover, a device for carrying out this method is also described.

SUMMARY OF THE INVENTION

This object is achieved, according to the invention, as far as the method is concerned by the features of a first method embodiment and, as far as the device is concerned, by the features of a first apparatus embodiment. Various other embodiments, in accordance with the present invention, are disclosed herein as further particularly advantageous embodiments of the invention.

In accordance with a first method embodiment of the invention, a method for controlling the cadence of an automatic weapon (1) is provided, and characterized in that when a cadence is predefined that would lead to resonant oscillating of the weapon barrel (13) of the automatic weapon (1), the cadence is modified from shot to shot so that the interval between successively triggered shots is alternately shorter and longer than the constant interval between the individual triggered shots, which is calculated for the predefined cadence in such a way that the desired cadence is obtained as a sum or time average cadence, and the resonant cadence is avoided.

In accordance with the first apparatus embodiment of the invention, a device for carrying out the method according to first embodiment is provided, wherein the device (4) comprises a fire control computer (8) with microcontroller (7), wherein the computer controls the triggered shot of the automatic weapon (1) and wherein the microcontroller (7) is programmed in accordance with the method embodiment according to the invention.

The invention is based essentially on the concept that, at a predefined cadence (i.e., fire speed) that leads to resonant oscillating of the weapon barrel of the automatic weapon, the cadence is modified from shot to shot so that the interval of time between successively triggered shots is alternately shorter and longer than a constant time interval between the individual triggered shots that is calculated for the predefined cadence, and in this way, the desired cadence is obtained as a sum, or time average, of the triggered shots that are triggered at time intervals that are alternately shorter and longer than at the calculated constant time interval corresponding to the predefined cadence (i.e., rate of fire).

If, therefore, a cadence of 200 shots/minute is desired by the customer and the selection of this cadence leads to undesired barrel oscillations because a shot is triggered every 300 ms (i.e., this is the calculated constant time interval between shots corresponding to the firing speed of 200 shots/minute), the present invention pertains to selecting the cadence so that the cadence is not kept constant, but to vary the cadence alternately with time so that after the first shot, shot triggering for the next shot takes place that is, for example 5%, below 300 ms (i.e., it is at 285 ms), then subsequently varying shot triggering so it has, with a third shot, a value 5% higher (i.e., at 315 ms), then again the shot triggering is shorted to 285 ms with the fourth shot, and so on for additional shots. In this manner, the oscillation behavior of the weapon barrel is kept outside the resonant cadence and, nonetheless, the desired cadence (i.e., rate of fire) is obtained as a sum, or average, of all the modified cadences over time. In other words, the present invention avoids the problem of resonant cadence at the desired rate of fire for the automatic weapon by alternately increasing and decreasing the time interval between triggered shots so that the sum of the shots over time averages out to the desired cadence without ever subjecting the barrel of the automatic weapon to the resonant cadence because the time interval between two successive shots is never at the firing rate of the resonant cadence.

Unlike with known weapon configurations whose discharge is triggered by means of a device for controlling the cadence, when the method according to the present invention is used no new barrel development is required even though the weapon is to be operated in the range of the resonant cadence; instead, only a modification of the programming of the fire control computer takes place in accordance with the method according to the invention.

The amount by which the triggered shot must be modified, at least in comparison with the constant value corresponding to the calculated fire rate for the predefined cadence in order that considerable barrel oscillations no longer occur, must be determined by bombardment tests (i.e., firing tests) depending on the type of weapon. It has been found, however, by the present inventors that it is sufficient if the variation in triggering time interval is between 2 and 10% of the constant time interval.

With respect to the device for controlling the cadence, in accordance with the present invention, in the case of automatic weapons whose discharge takes place with the aid of electrical or electronic triggering, it can preferably be a matter of programming the fire control computer assigned to the weapon, wherein the programming of the computer is selected in accordance with the method according to the invention. However, it can also be provided that the cadence is modified by mechanical means instead of, or in addition to, modifying the triggering time interval by electrical triggering in accordance with the method of the present invention.

BRIEF SUMMARY OF THE DRAWINGS

Other details and advantages of the invention are evident from the following exemplary embodiment explained below based on FIG. 1, which diagrammatically illustrates an automatic weapon connected to an apparatus embodiment of the present invention.

DETAILED DESCRIPTION OF THE INVENTION

In FIG. 1, 1 refers to a diagrammatically represented automatic weapon that comprises an electromechanical discharge device 2 that is connected via an electrical line 3 to a device 4, according to the invention, for controlling the cadence (i.e., fire rate) of the automatic weapon 1. The discharge device 2 essentially comprises an electromagnet 5 whose armature 6 acts on a discharge lever, not shown, of the automatic weapon 1. Thus, the discharge device 2 operates to activate the discharge lever of the automatic weapon 1, which results in the automatic weapon firing a shot.

The device 4 comprises essentially a fire control computer 8 that comprises a microcontroller 7, an operating element 9 provided with firing key 10, and a switch mechanism 11. The switch mechanism 11 connects a power supply 12 to the discharge device 2 as soon as the fire control computer 8 of the device 4 gives a corresponding control signal to the switch mechanism 11, but only after the firing key 10 has been activated.

The control signals generated by the microcontroller 7, in accordance with the method according to the present invention, are selected such that when a certain cadence is predefined for the automatic weapon that would lead to resonant oscillating of the weapon barrel 13 of the automatic weapon 1, the actual cadence of the automatic weapon 1 is modified from shot to shot so that the time interval between successively triggered shots is alternately shorter and longer than the corresponding constant interval that would otherwise exist between the individual triggered shots as calculated for the predefined cadence. In this way, the desired cadence is obtained over time as the sum of the shots over time (i.e., a time-average, wherein the desired cadence is obtained as the sum of the shots fired over a relatively longer period of time when compared to the time interval between individual shots).

For example, if a cadence of 200 shots/minute is desired based on different parameters (e.g., effect on the target, ammunition consumption) and the selection of this cadence would otherwise lead to undesired barrel oscillations when a shot is triggered constantly every 300 ms (i.e., at the calculated constant time interval corresponding to the firing rate of 200 shots/minute), the method according to the invention is to modify the cadence alternately so that after the first shot is fired, a second triggered shot takes place that is, for example, fired at 5% below 300 ms (i.e., fired at 285 ms after the first shot), then subsequently a third shot is fired that has a time interval value that is higher by 5% (i.e., the third shot is fired at 315 ms after the second shot), and then again the fourth shot is fired at 285 ms after the third shot, and so on. In this way, the average cadence over time for the four shots would be equal to (4 shots)/(285 ms+315 ms+285 ms+315 ms), or 200 shots/minute. Thus, the cadence of the automatic weapon 1 averages out over time to the desired cadence of 200 shots per minute even though the barrel 13 of the automatic weapon 1 never actually experiences, shot-by-shot, a cadence of 200 shots per minute. Instead, the time interval of 285 ms between the first and second shots corresponds to an actual cadence of 210 shots/minute and the time interval of 310 ms between the second and third shots corresponds to an actual cadence of 190 shots/minute, and the time interval of 285 ms between the third and fourth shots corresponds to an actual cadence of 210 shots/minute, and so forth for subsequent shots so that the actual cadence varies between 190 and 210 shots/minute between successive shots. In this way, the time-averaged cadence over a relatively longer period of time, such as minute, is 200 shots/minute. Thus, in accordance with the present invention, the fire control computer 8 generates signals so as to vary the cadence from shot to shot so that, over time, the automatic weapon 1 appears to fire at the predefined cadence without the automatic weapon actually ever firing, shot-by-shot, at the resonant cadence.

In sum then, a method for controlling the cadence of an automatic weapon (1), in accordance with the present invention, includes the steps of: (a) providing an automatic weapon that includes a weapon barrel, wherein the automatic weapon has a predefined cadence that would lead to resonant oscillating of the weapon barrel of the automatic weapon; (b) providing a fire control computer operably connected to trigger shots from the automatic weapon at an actual cadence shot by shot; (c) using the fire control computer to modify the actual cadence of the automatic weapon from shot to shot so that an actual time interval between successively triggered shots is alternately shorter and longer than a calculated constant time interval between individual triggered shots, wherein the calculated constant time interval is calculated based on the predefined cadence and corresponds to a constant interval of time required between successive shots to fire the automatic weapon at the predefined cadence; and (d) due to modifying the actual cadence of the automatic weapon using the fire control computer, firing the automatic weapon at an average cadence that is an average over time of modified actual cadences, wherein the average cadence is equal to the predefined cadence while avoiding resonant oscillating of the weapon barrel.

In addition, in accordance with the present invention, a device (4) is operably connected to control cadence of an automatic weapon (1), wherein the automatic weapon includes a weapons barrel (13), and the automatic weapon has a predefined cadence that would lead to resonant oscillating of the weapon barrel. The device (4) comprises a fire control computer (8) provided with a microcontroller (7), wherein the fire control computer controls triggered shots of the automatic weapon at an actual cadence shot by shot, and wherein the microcontroller is programmed to cause the fire control computer to execute the steps of: (a) modifying the actual cadence of the automatic weapon from shot to shot so that an actual time interval between successively triggered shots is alternately shorter and longer than a calculated constant time interval between individual triggered shots, wherein the calculated constant time interval is calculated based on the predefined cadence and corresponds to a constant interval of time required between successive shots to fire the automatic weapon at the predefined cadence; and (b) due to modifying the actual cadence of the automatic weapon using the fire control computer, firing the automatic weapon at an average cadence that is an average over time of modified actual cadences, wherein the average cadence is equal to the predefined cadence while avoiding resonant oscillating of the weapon barrel.

In accordance with a preferred embodiment of the present invention, the predefined cadence is a resonant cadence predefined by inertia of an action (i.e., firing mechanism) of the automatic weapon. In accordance with another preferred embodiment of the present invention, the fire control computer modifies the actual cadence of the automatic weapon from shot to shot so that the actual time interval between successively triggered shots is alternately shorter and longer than the calculated constant time interval by between 2% and 10% of the calculated constant time interval.

Of course, the invention is not restricted to the exemplary embodiment described above; thus, instead of employing electrical triggering of the triggered shot, for example, a mechanical control of the cadence can also take place. Furthermore, while the variation in the time interval between successive shots may preferably be controlled by the fire control computer 8 so as to be between 2 and 10% of that of the calculated constant time interval, it is within the scope of the present invention to employ greater variations in the time interval between successive shots in order to avoid resonant cadence of the barrel 13 of the automatic weapon 1.

LIST OF REFERENCE NUMBERS

1 Automatic weapon
2 Discharge device
3 Line
4 Device
5 Electromagnet
6 Armature
7 Microcontroller
8 Fire control computer
9 Operating element
10 Firing key
11 Switch mechanism
12 Power supply
13 Weapon barrel

The invention claimed is:

1. A method for controlling the cadence of an automatic weapon, the method comprising the steps of:

(a) providing an automatic weapon that includes a weapon barrel, wherein the automatic weapon has a predefined cadence that would lead to resonant oscillating of the weapon barrel of the automatic weapon;

(b) providing a fire control computer operably connected to trigger shots from the automatic weapon at an actual cadence shot by shot;

(c) using the fire control computer to modify the actual cadence of the automatic weapon from shot to shot so that an actual time interval between successively triggered shots is alternately shorter and longer than a calculated constant time interval between individual triggered shots, wherein the calculated constant time interval is calculated based on the predefined cadence and corresponds to a constant interval of time required between successive shots to fire the automatic weapon at the predefined cadence; and (d) due to modifying the actual cadence of the automatic weapon using the fire control computer, firing the automatic weapon at an average cadence that is an average over time of modified actual cadences, wherein the average cadence is equal to the predefined cadence while avoiding resonant oscillating of the weapon barrel.

2. A method according to claim 1, wherein the predefined cadence is a resonant cadence predefined by inertia of an action of the automatic weapon.

3. A method according to claim 2, wherein the fire control computer modifies the actual cadence of the automatic weapon from shot to shot so that the actual time interval between successively triggered shots is alternately shorter and longer than the calculated constant time interval by between 2% and 10% of the calculated constant time interval.

4. A method according to claim 1, wherein the fire control computer modifies the actual cadence of the automatic weapon from shot to shot so that the actual time interval between successively triggered shots is alternately shorter and longer than the calculated constant time interval by between 2% and 10% of the calculated constant time interval.

5. A device operably connected to control cadence of an automatic weapon according to claim 1, wherein the fire control computer modifies the actual cadence of the automatic weapon from shot to shot so that the actual time interval between successively triggered shots is alternately shorter and longer than the calculated constant time interval by between 2% and 10% of the calculated constant time interval.

6. A device operably connected to control cadence of an automatic weapon, wherein the automatic weapon includes a weapons barrel, and the automatic weapon has a predefined cadence that would lead to resonant oscillating of the weapon barrel, and the device comprises;

(a) a fire control computer provided with a microcontroller, wherein the fire control computer controls triggered shots of the automatic weapon at an actual cadence shot by shot, and wherein the microcontroller is programmed to cause the fire control computer to execute the steps of i. modifying the actual cadence of the automatic weapon from shot to shot so that an actual time interval between successively triggered shots is alternately shorter and longer than a calculated constant time interval between individual triggered shots, wherein the calculated constant time interval is calculated based on the predefined cadence and corresponds to a constant interval of time required between successive shots to fire the automatic weapon at the predefined cadence; and ii. due to modifying the actual cadence of the automatic weapon using the fire control computer, firing the automatic weapon at an average cadence that is an average over time of modified actual cadences, wherein the average cadence is equal to the predefined cadence while avoiding resonant oscillating of the weapon barrel.

7. A device operably connected to control cadence of an automatic weapon according to claim 6, wherein the predefined cadence is a resonant cadence predefined by inertia of an action of the automatic weapon.

8. A device operably connected to control cadence of an automatic weapon according to claim 7, wherein the fire control computer modifies the actual cadence of the automatic weapon from shot to shot so that the actual time interval between successively triggered shots is alternately shorter and longer than the calculated constant time interval by between 2% and 10% of the calculated constant time interval.

* * * * *